US010012458B2

(12) United States Patent
O'Clair et al.

(10) Patent No.: US 10,012,458 B2
(45) Date of Patent: Jul. 3, 2018

(54) BOLT FOR FIREARM

(71) Applicant: Smith & Wesson Corp., Springfield, MA (US)

(72) Inventors: Sean O'Clair, Feeding Hills, MA (US); Gary Zukowski, Ludlow, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 15/482,839

(22) Filed: Apr. 10, 2017

(65) Prior Publication Data

US 2017/0328656 A1 Nov. 16, 2017

Related U.S. Application Data

(60) Provisional application No. 62/335,347, filed on May 12, 2016.

(51) Int. Cl.

| | |
|---|---|
| ***F41A 3/66*** | (2006.01) |
| ***F41C 3/00*** | (2006.01) |
| ***F41A 9/65*** | (2006.01) |

(52) U.S. Cl.

CPC ..... *F41A 3/66* (2013.01); *F41A 9/65* (2013.01); *F41C 3/00* (2013.01)

(58) Field of Classification Search

CPC ..... F41A 3/64; F41A 3/66; F41A 3/00; F41A 3/12; F41A 3/54; F41C 3/00

USPC ..... 89/196; 42/14, 50, 18, 6

See application file for complete search history.

(56) References Cited

U.S. PATENT DOCUMENTS

| | | | | |
|---|---|---|---|---|
| 1,911,494 | A * | 5/1933 | Floyd | F41A 17/28 42/1.04 |
| 3,345,770 | A * | 10/1967 | Scanlon, Jr. | F41A 3/74 42/18 |
| 4,723,369 | A | 2/1988 | Badali | |
| 4,977,814 | A | 12/1990 | Beretta | |
| 5,615,505 | A * | 4/1997 | Vaid | F41A 9/61 42/18 |
| 6,623,609 | B2 | 9/2003 | Barkan | |
| 8,065,950 | B2 * | 11/2011 | Kaminsky | F41A 5/20 89/171 |
| 8,333,142 | B1 * | 12/2012 | Karfiol | F41A 9/25 89/196 |
| 8,839,541 | B1 * | 9/2014 | Karfiol | F41A 9/55 42/6 |
| 2016/0047613 | A1 * | 2/2016 | Hudson, III | F41A 3/86 42/14 |

FOREIGN PATENT DOCUMENTS

| | | |
|---|---|---|
| GB | 429765 | 6/1934 |
| GB | 1074646 | 7/1967 |

* cited by examiner

*Primary Examiner* — John Cooper
(74) *Attorney, Agent, or Firm* — John A. Chionchio, Esquire; Ballard Spahr, LLP

(57) ABSTRACT

A pistol has a bolt with a surface that contacts the cartridge in the magazine to next be chambered. The bolt is mounted within the slide. As the bolt moves with the slide out of battery the surface exerts a force on the cartridge in the direction of motion of the slide. The force counteracts inertial forces on the cartridge imposed by recoil of the pistol.

9 Claims, 4 Drawing Sheets

BOLT FOR FIREARM

CROSS REFERENCE TO RELATED APPLICATION

This application is based upon and claims benefit of priority to U.S. Provisional Application No. 62/335,347, filed May 12, 2016, the Provisional Application being hereby incorporated by reference.

FIELD OF THE INVENTION

This invention relates to bolts for firearms, and especially to bolts for semiautomatic pistols.

BACKGROUND

Reliability is an important attribute of a firearm, especially semiautomatic pistols. One heretofore overlooked opportunity to improve the reliability of pistols concerns the effect of inertial forces on cartridges in the magazine of the pistol. When the pistol is fired, momentum is conserved and reaction forces operate to force the pistol in a direction opposite to the direction of travel of the bullet, the well-known phenomenon of recoil. However, the cartridges are held only loosely in the magazine and resist moving in response to recoil by their own inertia. The cartridges in the magazine will thus appear to move in the opposite direction relative to the pistol due to the sudden application of the recoil forces. This can lead to malfunctioning of the pistol because the cartridge at the top of the magazine may not be in the most advantageous position when the slide moves into battery to strip it from the magazine and chamber it in the barrel. There would be a clear advantage to counteracting the inertial forces on the cartridges in the magazine.

SUMMARY

The invention concerns a slide for a pistol having a frame, the pistol being fed cartridges from a magazine received within the frame. In one example embodiment the slide comprises first and second sidewalls in spaced relation adjacent to one another and connected by a top wall. The sidewalls and top wall surround a central space. The sidewalls are engageable with the frame for reciprocating motion of the slide thereon between a first position in battery and a second position out of battery. A bolt is mounted within the central space. The bolt has a surface positionable in facing relation with one of the cartridges in the magazine when the sidewalls engage the frame. The surface contacts and exerts a force on the one cartridge in a direction of motion of the slide upon motion of the slide toward the out of battery position.

In a particular example embodiment, friction between the surface and the cartridge exerts the force on the cartridge. In another example embodiment, the surface comprises at least one step. The at least one step comprises a shoulder projecting from the surface toward the one cartridge. The shoulder faces the direction of motion of the slide toward the out of battery position. In another example embodiment the surface comprises a plurality of steps arranged one behind another along the direction of motion of the slide.

In another example embodiment a rib is mounted on the bolt. The rib extends lengthwise parallel to the direction of motion of the slide. In this example the surface is positioned on the rib. The bolt further comprises a breech face, and, in an example embodiment, the rib has an end positioned adjacent to the breech face.

The invention further encompasses a pistol fed cartridges from a magazine. In one example embodiment the pistol comprises a frame defining a magazine well. The magazine is receivable within the magazine well. A slide engages with the frame for reciprocating motion thereon between a first position in battery and a second position out of battery. A bolt is mounted within the slide. The bolt has a surface in facing relation with one of the cartridges in the magazine when the magazine is received within the magazine well. The surface contacts and exerts a force on the one cartridge in the direction of motion of the slide upon motion of the slide toward the out of battery position.

In a specific example embodiment of the pistol, the slide comprises first and second sidewalls in spaced relation adjacent to one another and connected by a top wall. The sidewalls and top wall surround a central space. The sidewalls are engaged with the frame for reciprocating motion. The bolt is mounted within the central space.

In one example embodiment, friction between the surface and the cartridge exerts a force on the cartridge. In one example embodiment, the surface comprises at least one step. The at least one step comprises a shoulder projecting from the surface toward the one cartridge. The shoulder faces the direction of motion of the slide toward the out of battery position. In another example embodiment the surface comprises a plurality of steps arranged one behind another along the direction of motion of the slide.

By way of further example, a rib is mounted on the bolt. The rib extends lengthwise parallel to the direction of motion of the slide. The surface is positioned on the rib in this example.

The bolt further comprises a breech face. In an example embodiment the rib has an end positioned adjacent to the breech face.

DETAILED DESCRIPTION

Figure 1:
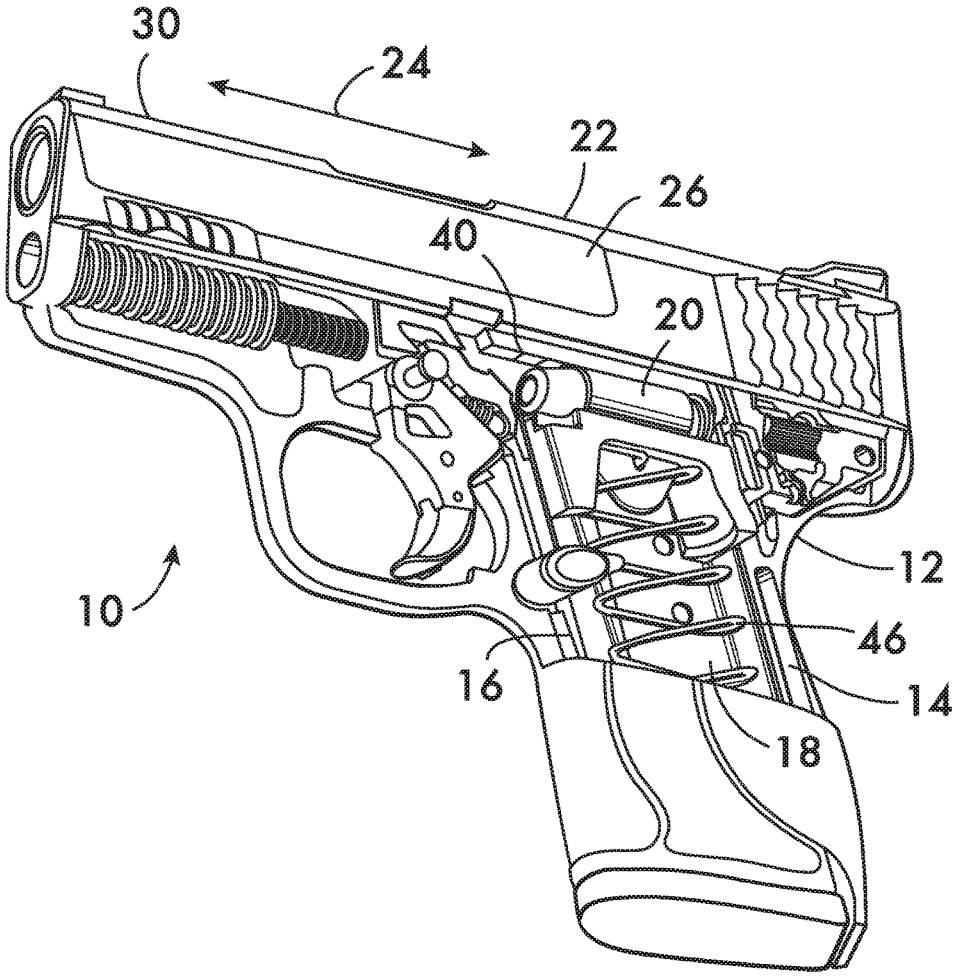
FIG. 1 is an isometric view of an example embodiment of a pistol according to the invention.
Figure 4:
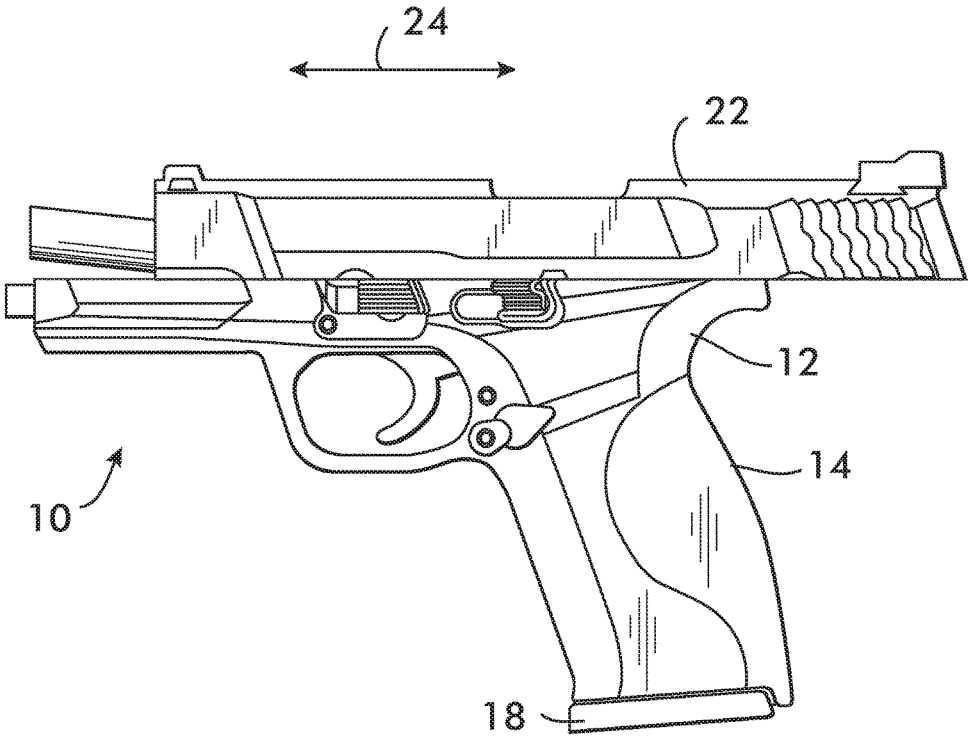
FIG. 4 is a right side view of the example pistol of FIG. 1 in operation.

FIG. 1 shows an example pistol 10 according to the invention. Pistol 10 comprises a frame 12 having a grip 14 defining a magazine well 16 which receives a magazine 18 holding cartridges 20 fed to the pistol. A slide 22 is mounted on frame 12. The slide 22 is reciprocably movable relative to frame 12 along a line of motion indicated by arrow 24 between a first position "in battery" (FIG. 1) and a second position "out of battery" (FIG. 4). Reciprocal motion of slide 22 occurs during cycling of the pistol as described below.

Figure 2:
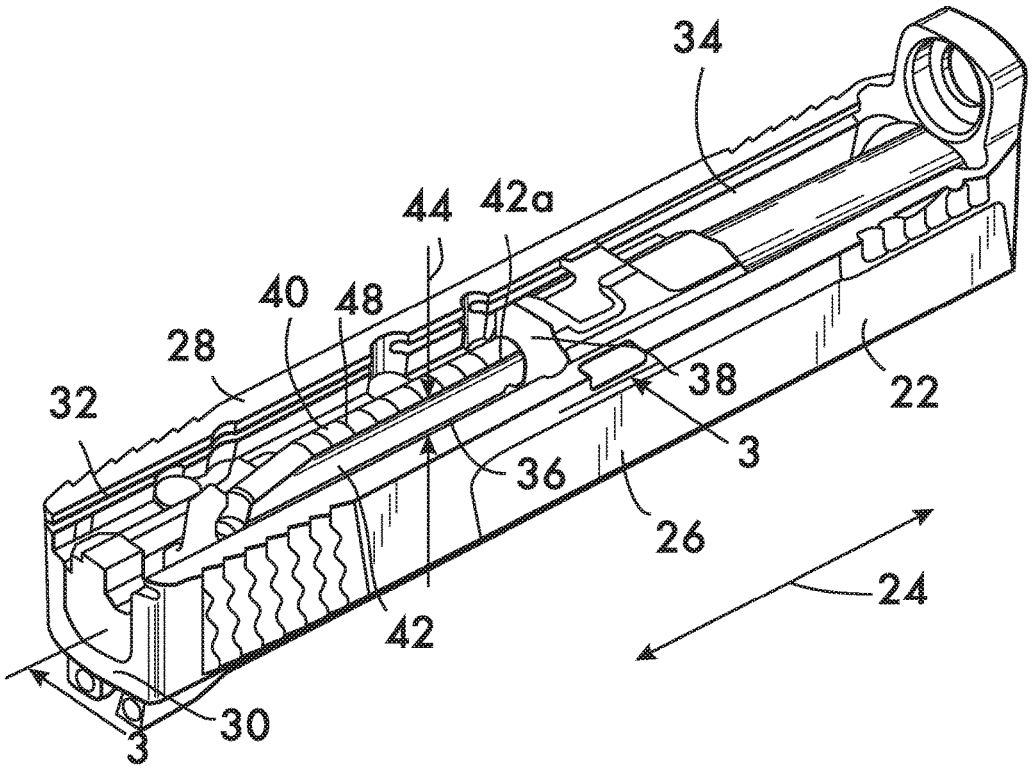
FIG. 2 is an isometric view of an example slide used with the pistol shown in FIG. 1.
Figure 3:
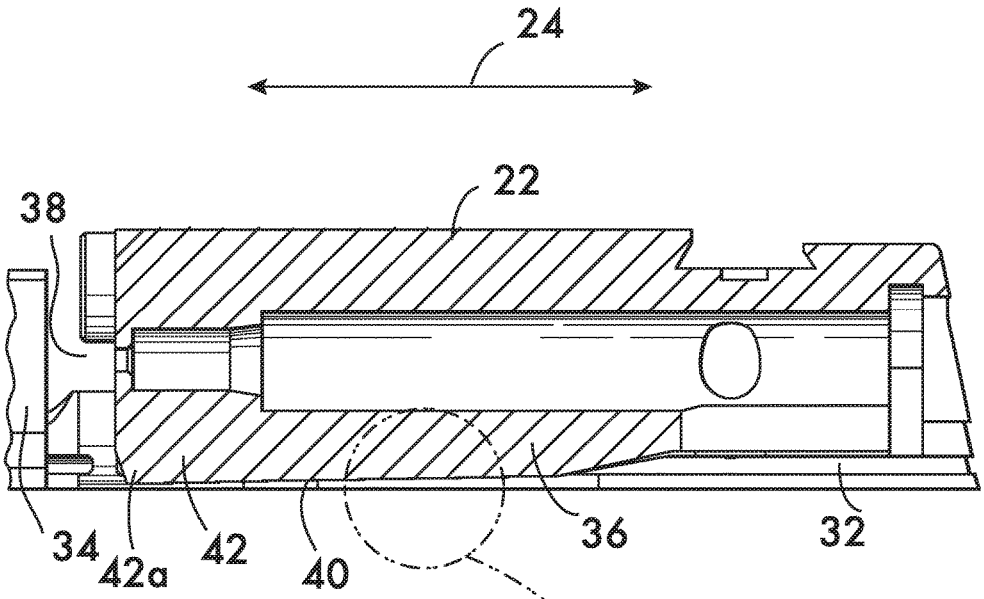
FIG. 3 is a sectional view taken at line 3-3 of FIG. 2.

As shown in FIG. 2, the example slide 22 comprises first and second sidewalls 26 and 28 arranged in spaced relation adjacent to one another. A top wall 30 (see also FIG. 1) connects the sidewalls 26 and 28. Grooves 32 in sidewalls 26 and 28 are arranged lengthwise along the slide 22 and engage respective rails (not shown) on frame 12 to permit the reciprocating motion of the slide during cycling of the pistol 10. The top wall 30 and sidewalls 26 and 28 surround a central space 34 in which a bolt 36 is mounted on the slide 22. As shown in FIG. 3, bolt 36 has a breech face 38 and a surface 40. In the example bolt 36 shown in FIG. 2 the surface 40 is positioned on a rib 42 mounted on the bolt 36. Rib 42 extends lengthwise parallel to the line of motion 24 of slide 22. As shown in FIGS. 2 and 3, one end 42*a* of the rib 42 is positioned adjacent to the breech face 38. As shown in FIG. 1, surface 40 is positioned in facing relation with the cartridge 20 being fed to the pistol 10 from the magazine 18 when the slide 22 engages the frame 12.

Figure 3A:
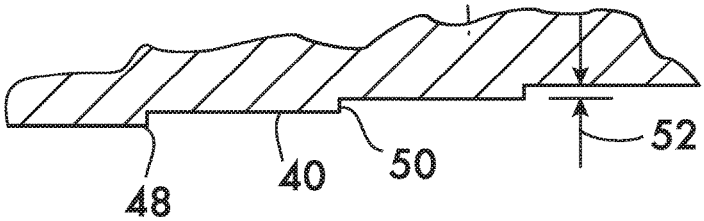
FIG. 3A is a partial sectional view on an enlarged scale taken from within the broken line circle of FIG. 3.

Surface 40 is further positioned so that it contacts the cartridge 20. In the example slide 22 shown in FIG. 2, the contact force between surface 40 and cartridge 20 is controlled by the depth 44 of the rib 42 and the stiffness of the follower spring 46 (see FIG. 1) in the magazine 18. The required contact force will depend upon the size of the cartridge, and the actual contact force experienced by a particular cartridge will vary with the number of cartridges in the magazine. A contact force ranging from about 3 lbs minimum (one cartridge in the magazine) to about 12 lbs maximum (full magazine) is considered practical for larger caliber cartridges such as the .45 caliber ACP round illustrated in FIG. 1. For smaller cartridges, such as the .22 caliber long rifle, the range of contact force will be smaller. Contact between the surface 40 and the cartridge 20 exerts a force on the cartridge along the line of motion 24 of the slide 22 when the slide moves out of battery as illustrated in FIG. 4. In one example embodiment, the force on cartridge 20 along the line of motion 24 is exerted solely through friction between the surface 40 and the cartridge 20. In the example slide embodiment shown in FIGS. 2 and 3, mechanical engagement between the surface 40 and the cartridge 20 augments the frictional engagement. Mechanical engagement is effected through the use of one or more steps 48 comprising the surface 40. As shown in detail in FIG. 3A, steps 48 comprise a shoulder 50 that projects from surface 40 toward the cartridge 20. Shoulder 50 also faces perpendicular to the line of motion 24 and in the direction of motion of the slide 22 when it moves out of battery. The depth 52 of the shoulder is from about 0.0015 inches to about 0.0025 inches, and can be as large as 0.007 inches in a practical design. In the example shown in FIGS. 2 and 3 a plurality of steps 48 are arranged one behind another along the line of motion 24 of the slide 22.

Operation of the pistol 10 is described with reference to FIGS. 1 and 4. As shown in FIG. 1, the slide 22 is in battery and a cartridge 20 in magazine 18 is presented to the pistol to be chambered. Surface 40, with steps 48 (see also FIGS. 2, 3 and 3A), contacts cartridge 20. Motion of the slide 22 out of battery as shown in FIG. 4, due either to discharge of a chambered round or the shooter racking the slide, causes relative motion between the slide 22 and the frame 12 along the slide line of motion 24. During this motion out of battery, contact between surface 40 and cartridge 20 results in a force being exerted on cartridge 20 in the direction of motion of the slide 22. The exerted force should not significantly affect operation of the pistol 10, but is expected to counteract any inertial forces operating on the cartridge 20, for example, inertial forces due to recoil of the pistol 10 when fired, which tend to move the cartridge toward the muzzle end of the pistol. The cartridge is thus moved to and/or maintained in the desired position within the magazine 18 so that when the slide 22 moves in the opposite direction and back into battery (FIG. 1) the cartridge 20 will be stripped from the magazine 18 and chambered with minimum risk of a misfeed and consequent stoppage.

What is claimed is:

1. A slide for a pistol having a frame, said pistol being fed cartridges from a magazine received within said frame, said slide comprising:

first and second sidewalls in spaced relation adjacent to one another and connected by a top wall, said sidewalls and top wall surrounding a central space, said sidewalls being engageable with said frame for reciprocating motion of said slide thereon between a first position in battery and a second position out of battery;

a bolt mounted within said central space, said bolt having a surface positionable in facing relation with one of said cartridges in said magazine when said sidewalls engage said frame, said surface comprising a plurality of steps arranged one behind another along a direction of motion of said slide, each one of said steps comprising a shoulder projecting from said surface toward said one cartridge, said shoulders facing said direction of motion of said slide toward said out of battery position, said steps contacting and exerting a force on said one cartridge in said direction of motion of said slide upon motion of said slide toward said out of battery position.

2. The slide according to claim 1, wherein friction between said surface and said cartridge exerts said force on said cartridge.

3. The slide according to claim 1, further comprising a rib mounted on said bolt and extending lengthwise parallel to said direction of motion of said slide, said surface being positioned on said rib.

4. The slide according to claim 3, wherein said bolt further comprises a breech face, said rib having an end positioned adjacent to said breech face.

5. A pistol fed cartridges from a magazine, said pistol comprising:

a frame defining a magazine well, said magazine being receivable within said magazine well;

a slide engaged with said frame for reciprocating motion thereon between a first position in battery and a second position out of battery;

a bolt mounted within said slide, said bolt having a surface in facing relation with one of said cartridges in said magazine when said magazine is received within said magazine well, said surface comprising a plurality of steps arranged one behind another along a direction of motion of said slide, each one of said steps comprising a shoulder projecting from said surface toward said one cartridge, said shoulders facing said direction of motion of said slide toward said out of battery position, said steps contacting and exerting a force on said one cartridge in said direction of motion of said slide upon motion of said slide toward said out of battery position.

6. The pistol according to claim 5, wherein said slide comprises:

first and second sidewalls in spaced relation adjacent to one another and connected by a top wall, said sidewalls and top wall surrounding a central space, said sidewalls being engaged with said frame for said reciprocating motion, said bolt being mounted within said central space.

7. The pistol according to claim 5, wherein friction between said surface and said cartridge exerts said force on said cartridge.

8. The pistol according to claim 5, further comprising a rib mounted on said bolt and extending lengthwise parallel to said direction of motion of said slide, said surface being positioned on said rib.

9. The pistol according to claim 8, wherein said bolt further comprises a breech face, said rib having an end positioned adjacent to said breech face.

* * * * *